United States Patent [19]

Arnall

[11] Patent Number: 4,615,365

[45] Date of Patent: Oct. 7, 1986

[54] TOOL SUPPORT FOR A WOOD TURNING LATHE

[76] Inventor: Harry L. Arnall, Lot 3, Enterprise Drive, Berkeley Vale, New South Wales, 2259, Australia

[21] Appl. No.: 799,156

[22] Filed: Nov. 18, 1985

[30] Foreign Application Priority Data

Nov. 19, 1984 [AU] Australia ..... 35674/84

[51] Int. Cl.[4] ..... B27C 7/06

[52] U.S. Cl. ..... 142/49

[58] Field of Search ..... 142/449, 48, 50, 55, 142/7

[56] References Cited

U.S. PATENT DOCUMENTS

| | | | |
|---|---|---|---|
| 839,752 | 12/1906 | Guenzler | 142/49 |
| 988,630 | 4/1911 | Diederich | 142/49 |
| 3,405,745 | 10/1968 | Schoonover et al. | 142/7 |
| 4,502,517 | 3/1985 | Larson | 142/49 |

*Primary Examiner*—Leonidas Vlachos

*Attorney, Agent, or Firm*—Stiefel, Gross, Kurland & Pavane

[57] ABSTRACT

The present invention provides a tool support for a hand held wood turning tool. The tool support includes a parallel sided elongated slot through which the tool extends during use and which restrains rotational movement of the tool about its longitudinal axis. The support also includes a planar support surface in front of the slot and provides additional tool support.

5 Claims, 1 Drawing Figure

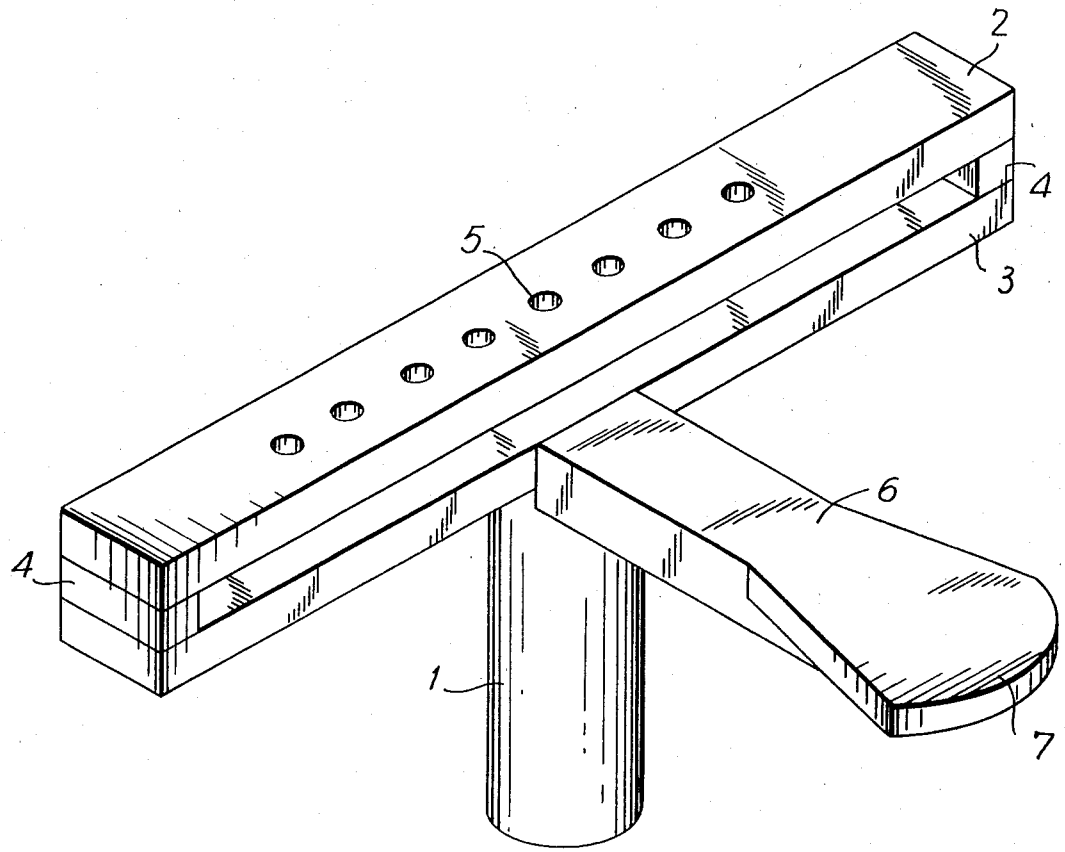
2
4
3
5
6
7
1
4

TOOL SUPPORT FOR A WOOD TURNING LATHE

This invention relates to a tool support to assist with the control of a hand held wood turning tool whilst specialty turning processes are performed. The processes envisaged occur in the hollowing out of articles such as goblets, cups, vases and bottles.

As will be understood by those skilled in wood turning leverage plays an important part in the control of wood working tools which are hand manipulated. It is important that there be a fulcrum-like support below and as close as possible to the cutting edge of the wood turning "chisel" so that the downward forces resulting from a cut being taken are able to be counterbalanced by a downward effort applied by the craftsman. Without such a support adequate control over the cutting action is not possible and quality work cannot be readily achieved.

The above requirement is particularly evident where the interior of an article of the type referred to above is to be formed. This invention provides a tool support specially developed to adequately support a hand manipulated wood working tool whilst the interior of such an article is formed.

According to the present invention there is provided a tool support comprising; an elongated body portion with a parallel sided slot therethrough extending along a major part of the body and adapted to pass the working head and at least part of the shank of a wood working chisel or like tool but to restrain rotational movement of such chisel or tool about its longitudinal axis; a post adapted to engage a tool support mount on a wood turning machine and to maintain the elongated body in a relationship to the piece being worked such that the parallel sided slot faces the work area; a support surface in front of the parallel sided slot and coplanar with one elongated side thereof adapted to provide additional support to a chisel or like woodturning tool extending through the slot.

One embodiment of the invention will now be described with reference to the accompanying drawing marked "FIG. 1" being a perspective view of an embodiment of the present invention.

Referring now to the accompanying drawing, the post 1 is for attachment of the device to a standard tool post holder, i.e. the tool support mount of a wood turning lathe.

The body of the device is preferably of welded construction comprised of upper and lower spaced bars 2 and 3 and spacers 4. The slot defined by the members 2, 3 and 4 is adapted to house a flat sided shank (i.e. rectangular or square in section) (not shown) of a wood turning tool such as a chisel. It will be appreciated that members 2 and 3 will consequently prevent rotational twisting of such a hand tool about its longitudinal axis. Desirably the tool shank thickness is not greatly less than the spacing between members 2 and 3 and the width dimension of the shank of the tool is much greater than its thickness, as is the case with wood turning chisels. The slot would normally be substantially horizontal when the device is in use and the post 1 will be substantially vertical.

A tool so supported is free to move along the slot and it will be appreciated that there will be a reduction in the controlling effort needed by the craftsman who need no longer concern himself with axial rotation of the tool. Indeed tool supports in accordance with the present invention have been so successful that they have permitted development of a new style of wood turning tool wherein the cutting head may be substantially offset from the main axis of the tool to facilitate clearing and hollowing out forms having a narrow opening but of widening diameter thereafter. Previously substantially offsetting the cutting head from the main longitudinal axis of the tool was not possible due to the impossibility of controlling the torsional forces generated by such offset cutting edge.

Holes 5 may be provided in bar 4 in order to pass pins (not shown) which may be used to provide a fulcrum and pivot point for a tool.

In addition to the forces tending to rotate a tool about its longitudinal axis a downward force is also generated upon the working head of a chisel or like wood turning tool which downward force will tend to cause the handle of the chisel or like wood turning tool to fly up; the tool pivoting about the parallel slot. To counteract this force and further free the craftsman to concentrate upon his work support platform 6 is provided. In this example it will be noted that the support platform extends laterally from the lower surface of the slot and centrally thereof to its free end formed as an enlargement 7.

Indeed it is the enlargement 7 which is the critical aspect of the support as in use it would be placed adjacent the area being worked to support the tool adjacent its working head.

It should be noted that post 1 is cylindrical in order that it can be rotated in the tool post holder of the wood turning lathe to provide continuous support for the cutting edge of the tool in proximity to the interior face of the work piece where material removal is taking place. It is for the same reason that the support surface is enlarged at 7 in order to accomodate and support a tool passing through the parallel sided slot at varying angles.

The claims defining the invention are as follows:

1. A tool support comprising; an elongated body portion with a parallel sided slot therethrough extending along a major part of the body and adapted to pass the working head and at least part of the shank of a woodturning chisel or like tool but to restrain rotational movement of such chisel or tool about its longitudinal axis; a post adapted to engage a tool support mount on a woodturning machine and to maintain the elongated body in a relationship to the piece being worked such that the parallel sided slot faces the work area; a support surface in front of the parallel sided slot and coplanar with one elongated side thereof adapted to provide additional support to a chisel or like woodturning tool extending through the slot.

2. A tool support as claimed in claim 1 wherein the supporting post is fixed adjacent the mid-length of the elongated body and substantially at right angles to the plane of the parallel sided slot and the support surface is coplanar with lower side of the parallel sided slot.

3. A tool support comprising; an elongated body portion with a parallel sided slot therethrough extending along a major part of the body and adapted to pass the working head and at least part of the shank of a woodturning chisel or like tool but to restrain rotational movement of such chisel or tool about its longitudinal axis; a post adapted to engage a tool support mount on a woodturning machine and to maintain the elongated body in a relationship to the piece being worked such that the parallel sided slot faces the work area; a support surface extending laterally from the mid-length of one of the elongated parallel sides and coplanar therewith terminating in an enlargement adapted to provide additional support to a chisel or like woodturning tool extending through the slot.

4. A tool in accordance with claim 1 including means to restrict movement of a chisel or like tool along the elongated slot and to provide a fulcrum about which a chisel or like tool may pivot.

5. A tool support in accordance with claim 1 having a series of holes disposed along one member of the elongated body and adapted to pass pins into the elongated slot to provide a fulcrum about which a chisel or like tool may pivot.

* * * * *